US006382894B2

(12) United States Patent
Goodding

(10) Patent No.: US 6,382,894 B2
(45) Date of Patent: May 7, 2002

(54) SOFFIT INSTALLATION APPARATUS

(76) Inventor: Clinton Goodding, 2311 W. Apache, Farmington, NM (US) 87401

( * ) Notice: Subject to any disclaimer, the term of this patent is extended or adjusted under 35 U.S.C. 154(b) by 0 days.

(21) Appl. No.: 09/790,316

(22) Filed: Feb. 21, 2001

Related U.S. Application Data

(63) Continuation-in-part of application No. 09/226,284, filed on Jan. 7, 1999.

(51) Int. Cl.[7] ..... E04G 21/16
(52) U.S. Cl. ..... 414/11; 52/127.1; 52/749.1
(58) Field of Search ..... 52/749.1, 749.12, 52/127.1, 127.2, DIG. 1; 269/904; 414/10, 11

(56) References Cited

U.S. PATENT DOCUMENTS 3,175,253 A * 3/1965 Xanten ..... 52/DIG. 1
4,068,427 A * 1/1978 Camaroo ..... 52/127.2
4,309,857 A 1/1982 Lovering
4,867,403 A 9/1989 Anderson ..... 52/DIG. 1
5,459,967 A 10/1995 Bodtker
5,732,527 A 3/1998 Schneider ..... 52/749.1

* cited by examiner

*Primary Examiner*—Michael Safavi
(74) *Attorney, Agent, or Firm*—Rod D. Baker

(57) ABSTRACT

An apparatus for installing soffit segments below the eaves of a building. A main body with a standoff is temporarily fastened to the sub-fascia. A swing arm and a locking arm are pivotally connected to each other and also to the main body, except that a J-shaped slot in the locking arm permits the locking arm to translate, as well as pivot, with respect to the main body. A segment of soffit material is placed upon the swing arm, and the swing arm is rotated about the pivot joint on the main body creating a lever action to lift the soffit material into a horizontal position immediately below the eave. The locking arm slot is notched to lock the locking arm and swing arm, into a fixed position. The apparatus thereby steadily maintains the soffit segment in position pending its permanent attachment to the underside of the eave. The apparatus is temporarily attached to the structure via a clamp arm or via screw into the sub-fascia.

13 Claims, 8 Drawing Sheets

SOFFIT INSTALLATION APPARATUS

CROSS-REFERENCE TO RELATED APPLICATIONS

This application is a continuation-in-part of patent application Ser. No. 09/226,284, entitled "Soffit Installation Apparatus", filed on Jan. 7, 1999, and the specification thereof is incorporated herein by reference.

BACKGROUND OF THE INVENTION

The present invention is an apparatus to aid with the installation of soffit beneath the eaves of buildings.

Buildings, particularly residential homes, often have eaves or a projecting edge. The outermost edge of the eave typically has a brief vertical section that is referred to as fascia. The under portion of the eave occasionally remains open, exposing the joist and rails of the trusses. More commonly, these areas are covered with a planar material such as plywood. This material is generally attached to a horizontal or nearly horizontal member of the support structure on the underside of the eave. If the described area is covered then the covering is usually referred to as "soffit."

Due to the location of the work to be done to install a soffit, and the time of the installation, this work is labor intensive (commonly requiring 2–3 workers), and can be hazardous for the worker(s).

U.S. Pat. No. 5,459,967 to Bodthker shows an adjustable support structure used to support various types of roofs.

U.S. Pat. No. 4,309,857 to Lovering discloses a soffit support structure used to support structure incorporating parallel spaced vertical props connected by a horizontal member, with the props having heads thereon for supporting a short beam for supporting the soffit.

The patents to Bodthker and Lovering reveal that a need still remains for a tool that reduces the labor, improves the efficiency, and economy of soffit installation. The invention presented here meets that need.

BRIEF SUMMARY OF THE INVENTION

An object of the present invention is to provide a soffit installation apparatus that improves the efficiency, economy, and safety of soffit installation beneath eaves.

The present invention is temporarily secured to the roof and or fascia of the eave and includes elements which permit a segment of soffit material to be swung into position horizontally immediately beneath the eave, and held in position while permanent attachment of the soffit is performed.

Advantages of this invention include simplicity and ease in use, operation by a single user, adaptability to related functions in the art of soffit installation, and economy of manufacture. The invention is easy to use by those skilled in the art of installing soffit and can be easily learned by those new to the art of soffit installation.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIGS. 2 and 4–8 show the components used to attach the optional clamp arm. To use the invention without the clamp arm, certain of the illustrated components are removed and a single screw is used as seen in FIG. 3.

DETAILED DESCRIPTION OF THE INVENTION

The apparatus of the invention may take several forms and embodiments, and this disclosure includes descriptions of two of those embodiments. The function is generally the same for all alternative embodiments and can be assumed to be the same except as to the differences particularly noted.

Figure 1:
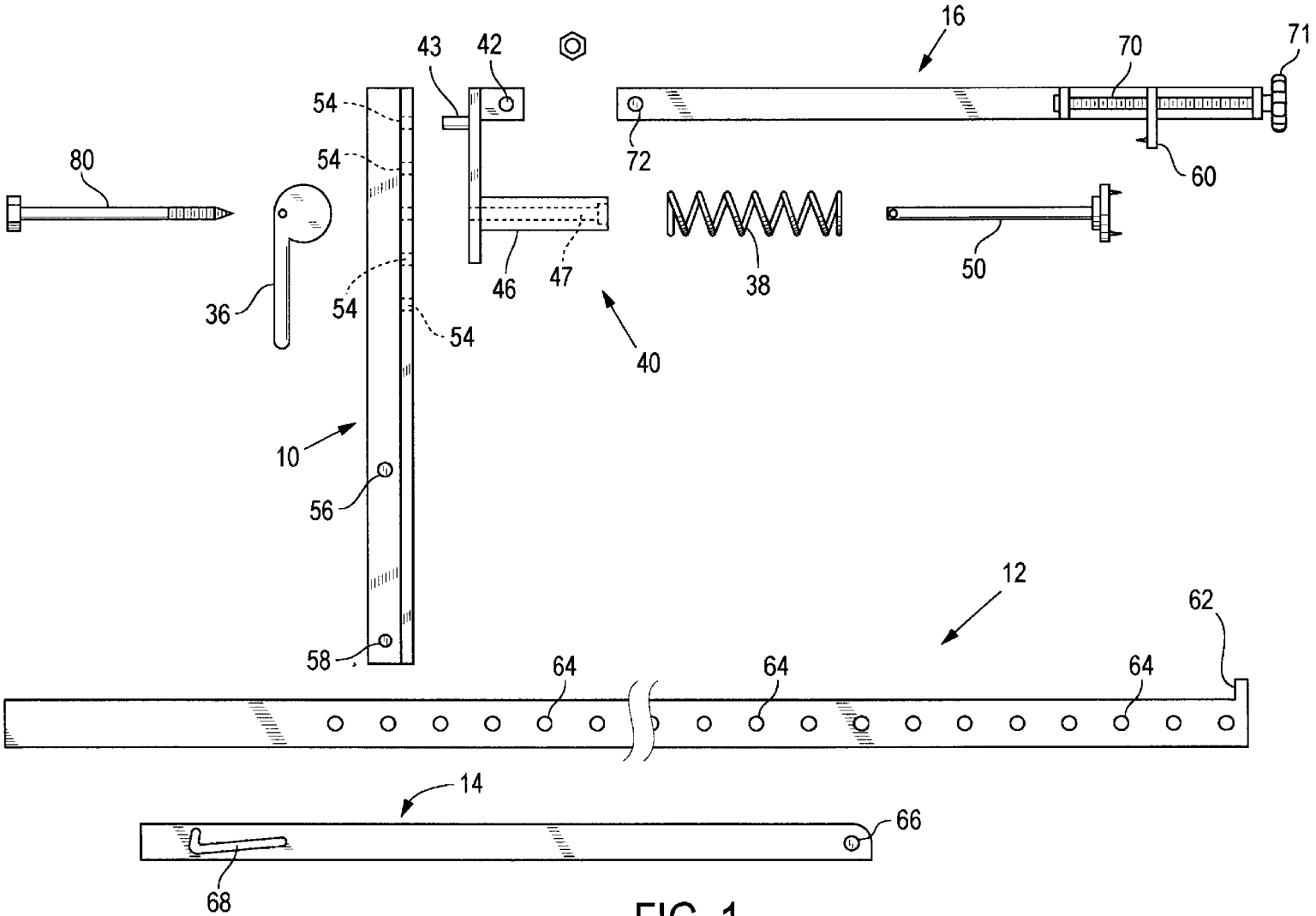
FIG. 1 is an exploded side view of a preferred embodiment of the apparatus of the invention.
Figure 2:
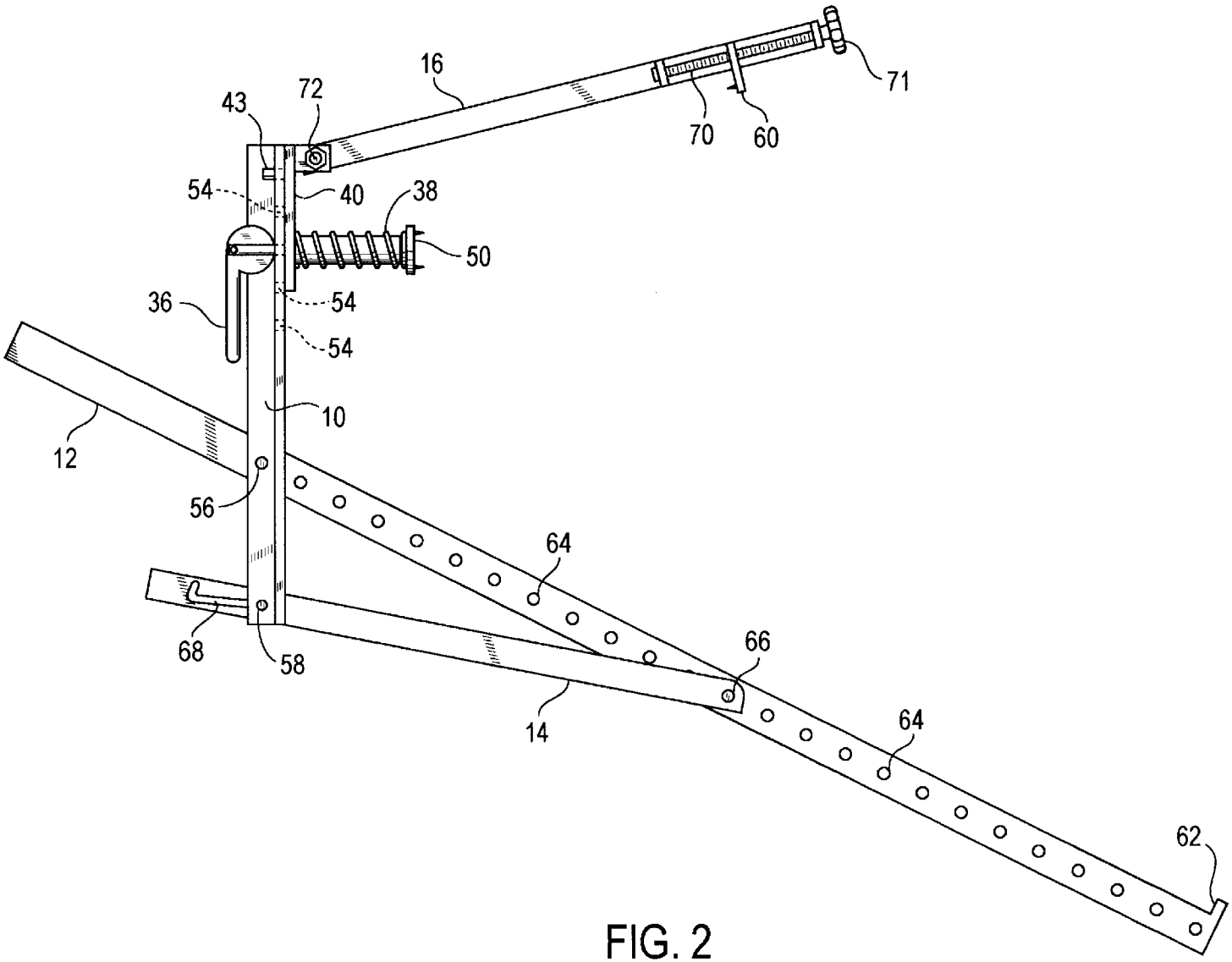
FIG. 2 is a right side view of the apparatus depicted in FIG. 1, showing the apparatus assembled for use.
Figure 3:
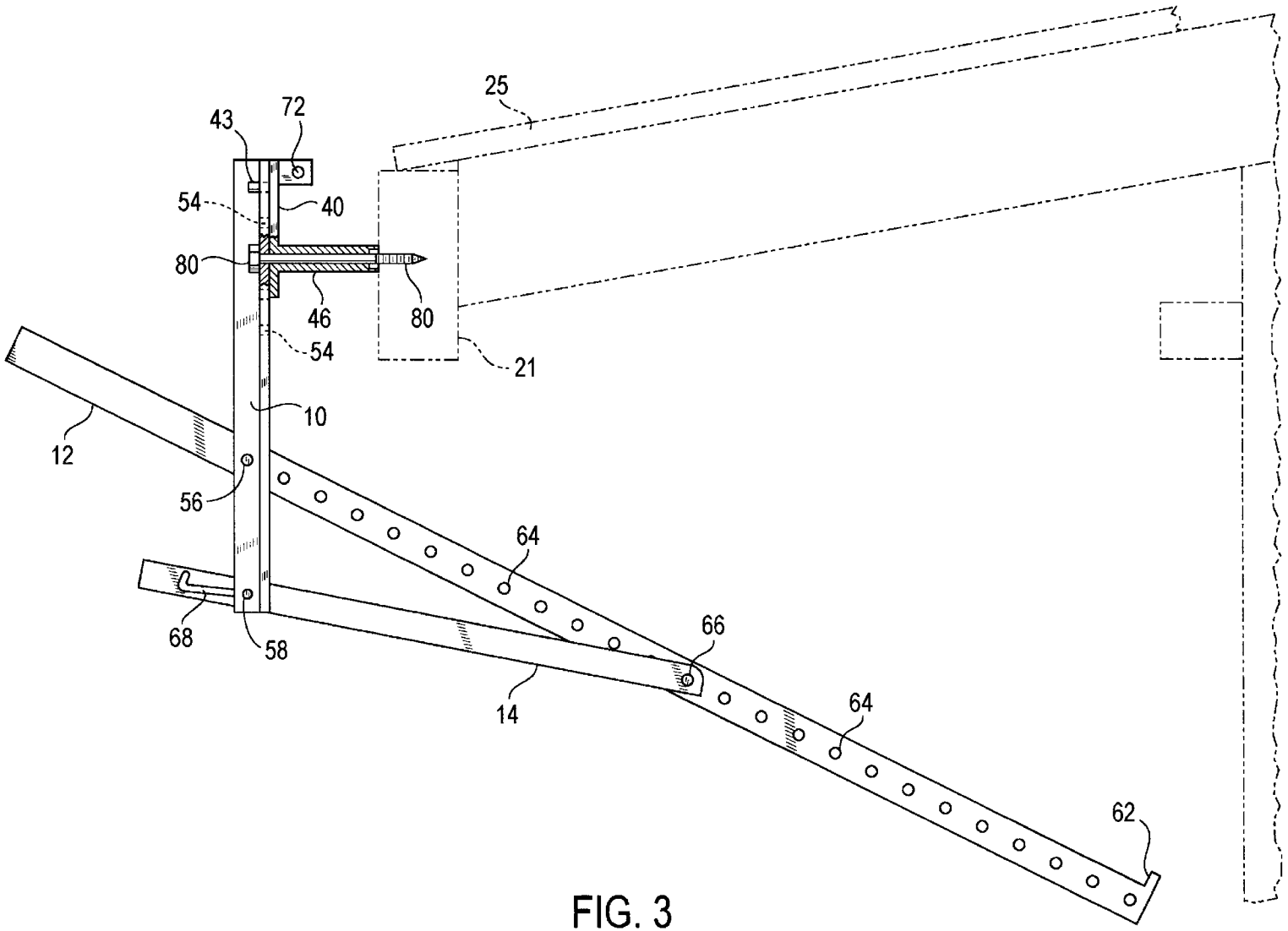
FIG. 3 is an elevation view of an alternative embodiment of the apparatus of the invention, shown in use position upon the eave of a building.

A broad description of the apparatus is made with reference to FIGS. 1–3: The apparatus is made of four main elements with a fifth element that is optional. The first element is the standoff 40 which is used in either of the embodiments described herein to temporarily fasten the apparatus. The second element is the main body 10 which aligns nearly parallel to the sub-fascia 21. The third main element is a swing arm 12 which allows the soffit material 23 to be placed for lifting into position for final installation. The fourth main element is a lock arm 14 that temporarily locks the swing arm into position while the soffit material 23 is affixed to the structure, as suggested in FIG. 3. A fifth element, a clamp arm 16, may be used (if preferred). Clamp arm 16 aligns to the roofline 25 and hooks to a batten 27 previously temporarily installed by the roofer.

Standoff Assembly Detail:

A. Movably attached to the main body 10 is a standoff 40. Standoff 40 allows the main body 10 to remain nearly parallel to the sub-fascia 21 with no interference from the roof decking material 25 or other parts that may protrude outward beyond the sub-fascia 21, thereby preventing the desired alignment of the main body 10.

B. The upper part of the standoff 40 has a hole 42 therein for attaching the clamp arm 16 to the standoff. A pin 43 on standoff 40 mounts through a corresponding hole the main body 10.

C. A boss 46, integral to the standoff 40, defines a coaxial hole 47 passing there through.

D. Other components of the standoff assembly are a release cam 36, a spring 38, and a spring retainer 50. The standoff assembly has two alternative embodiments: the first is for use with the optional clamp arm 16; the other is for use when the clamp arm 16 is not employed.

E. If the clamp arm 16 is not used, a lag screw 80 (see FIG. 3) passes through the hole 47 to attach the main body 10 to the sub-fascia 21. If the clamp arm 16 is used, then a spring 38 is placed over the boss 46, and the spring retainer 50 is passed through the spring 38 and the hole 47, and is pivotally anchored to a cam lever 36 on the far side of the main body 10.

F. The purpose of the spring 38 is to maintain tension or force against the standoff 40 and the spring retainer 50, in turn applying pressure to the sub-fascia 21 and the hook 60 on the clamp arm 16. When the cam lever 36 is activated, the spring 38 is compressed and the forces against the sub-fascia 21 and the hook 60 on the clamp arm 16 are removed, allowing the operator to easily release the hook 60 from the batten 27.

Main Body Detail:

The main body 10 may be comprised of a "U" or "L" shaped material so long as there are at least two surfaces that are perpendicular to one another and form an outside corner or corners.

The main body holes 54 are positioned such that the pin 43 on the standoff 40 goes into an upper one of the holes 54 and a lag screw or the spring retainer is passed through a second lower one of the holes 54. Holes 54 are provided at uniformly spaced intervals along the main body 10 to allow adjustment for varying sub-fascia depths for proper operation and positioning of the swing arm 12. Below the bottom one of the adjusting holes 54 in the main body 10, a pin 56 is on the main body 10 for the mounting of the swing arm 12. Below the swing arm pin 56 another pin 58 is on the main body 10 for the attachment of the locking arm 14.

The main body 10 and the standoff 40 may be connected directly to the sub-fascia 21 via a lag or similar type screw or bolt 80 (FIG. 3). The use of a lag screw to attach the main body 10 to the subfascia 21 eliminates the need for the optional clamp arm 16, the spring 38, the retainer 50 and the cam lever 36. The main body 10 is an elongated shaft or strut to allow for the various depths of sub-fascia 21 that may be encountered.

Swing Arm Detail:

The swing arm 12 is sufficiently long to allow for soffit material that is up to 24 inches in width. On one end of the arm 12 there is a stop 62 upon which the soffit material 23 rests. For the swing arm 12 to be adjustable, a plurality of adjusting holes 64 are provided at uniform intervals along the swing arm, as seen in FIG. 1. The holes 64 are for the pivotal attachment of the swing arm 12 to the main body 10 and to the lock arm 14. Depending upon the width of the soffit material 23 being installed, the appropriate holes 64 are selected for assembly from job to job. The holes 64 start from the end of the swing arm having the stop 62 and are spaced toward the end away from the stop, and there are, for example, 25 adjusting holes 64. The adjustable connections between the main body 10, the locking arm 14 and the swing arm 12 allows adjustment for soffit material widths from 12 to 24 inches.

Locking Arm Detail:

The locking arm 14 has a pivot pin 66 at one end. Proximate to the opposite end of the locking arm 14 is a sideways "J" slot 68 having a short leg nearly perpendicular to the long axis of the locking arm.

Clamp Arm Detail:

The clamp arm 16 is an optional element, and is described here as an element of a preferred embodiment of the invention. On the distal end is provided an adjusting screw 70 with a hook 60 attached. The hook 60 adjusts as it follows the threads of the adjusting screw as the adjusting screw is manually turned at the knob 71. This allows for the adjustment of the position of the hook 60 along the clamp arm 16 to accommodate the varying positions of batten 27. On the other end of the clamp arm 16 there is provided a threaded pin 72 and lock nut for pivotal mounting to the top of the standoff 40, to accommodate varying roof slopes.

Assembly:

The swing arm 12 and the locking arm 14 are pivotally connected via a hole 64, a pin 66 and a retainer pin. The swing arm 12 is pivotally attached to the lower portion of the main body 10 via a hole 64, a projecting pin 56 and a retainer pin (such as a cotter pin, inserted laterally through the pin 56). Swing arm 12 is mounted via holes 64 so as to support varying widths of the soffit material 23. The locking arm 14 is pivotally attached to the main body 10 via the J-slot 68, a pin 58 and a retainer pin.

The pin 43 on the standoff 40 is aligned to the desired one of the holes 54 in the main body 10 for the depth of the sub-fascia to be worked with, and the standoff 40 is attached to the main body 10 with a retainer pin (e.g., a cotter pin).

If the clamp arm 16 is to be used, it is pivotally attached at the hole 42 in the standoff 40 using threaded pin 72 and a lock nut, so that while the apparatus is in use, the main body 10 maintains a position parallel to the sub-fascia. When the clamp arm 16 is used, the spring 38 is placed over the boss 46 and the spring retainer 50 is passed through the spring 38 and the hole 47 in the boss 46 and through one of the holes 54 of the main body 10; the cam lever 36 is then pivotally anchored to the spring retainer 50 with a retainer pin such as a cotter pin.

Using The Apparatus:

Once the assembly has been completed for the desired soffit material width, and the depth of the sub-fascia, the apparatus is attached to the sub-fascia. Positioning of the apparatus is such that it is about the center of where the soffit material will be installed. If the clamping arm 16 is used, the hook 60 is placed over the temporary batten 27, and the apparatus is allowed to hang free. The cam lever 36 is rotated to release the spring 38 and the spring retainer 50 engages the sub-fascia 21. The hook 60 sinks into the batten 27 and the apparatus is ready to be loaded.

Figure 4:
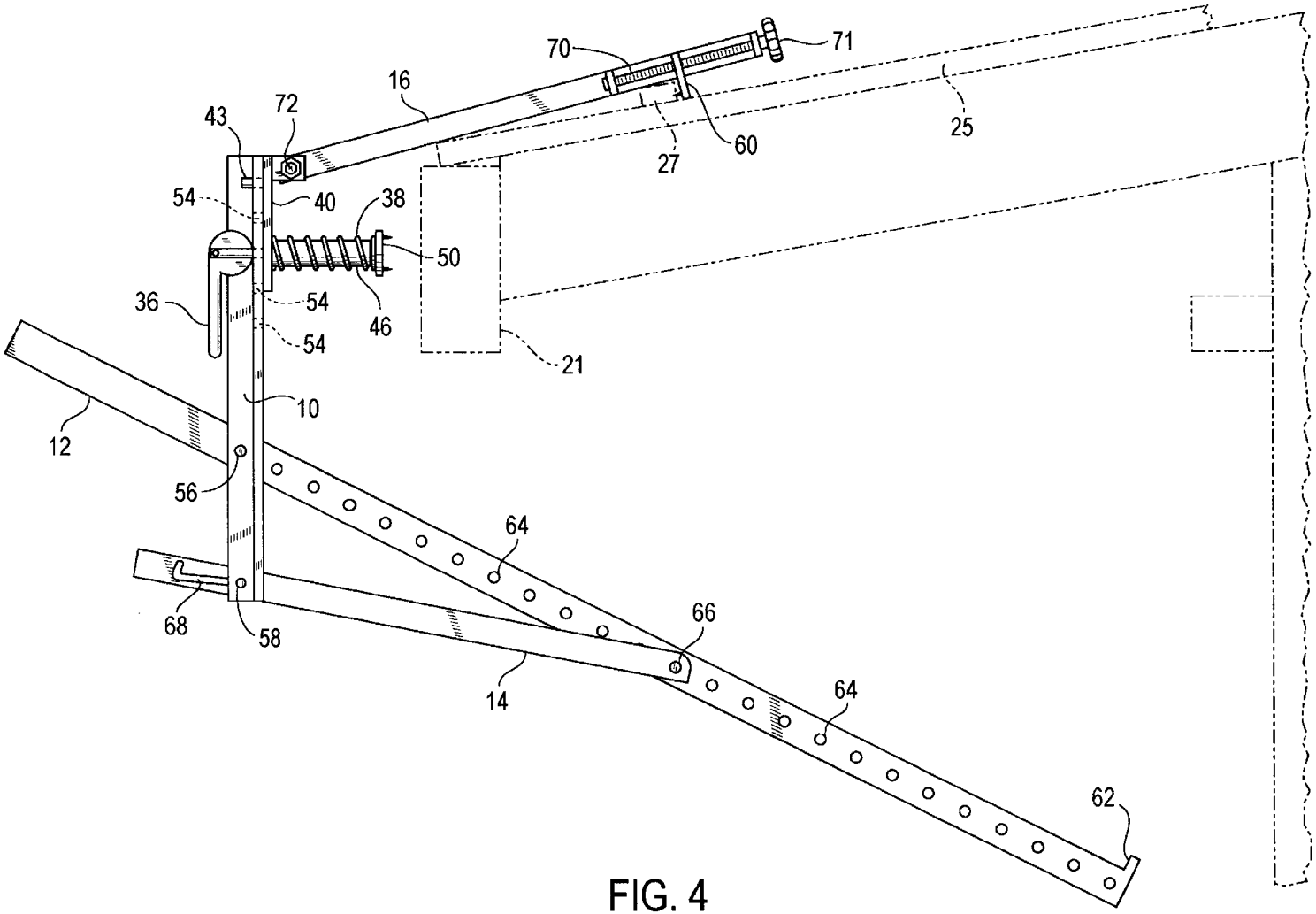
FIG. 4 is an elevation view of the preferred embodiment seen in FIG. 2, in preliminary position partially disposed upon an eave of a building.

Initially, the locking arm 14 should not be in the locked position, and the swing arm 12 should be hanging down from the eave (FIG. 4). The soffit material 23 is loaded such that the length of the material 23 is about centered on the stop 62 on the swing arm 12. The soffit material 23 is rotated toward the eave until the short leg of the J-slot 68 drops over pin 58 of the main body 10. The soffit material 23 thus is swung in position for final attachment to the structure, as seen in FIGS. 5–8. Once the soffit material 23 has been installed the apparatus can be moved to the next location.

The practice of the invention may now be described. Broadly summarized, the use of the apparatus begins by pivoting the swing arm 12 into an open position (FIGS. 3, 4). The apparatus is temporarily attached to the subfascia 21, and the segment of soffit 23 is placed in a balanced position upon the swing arm 12 (as suggested in FIG. 5). With a single smooth motion (as the J-slot 68 in the lock arm 14 slides along the main body 10 on pivot pin 58), the outside or proximate end of the swing arm 12 is pulled down, levering the distal end of the swing arm upward as the swing arm pivots about its connection with the main body 10. When the J-slot 68 slides on pin 58 to the short leg of the slot, it drops into place to lock the lock arm 14 against further movement. The lock arm 14, swing arm 12 and main body 10 thus are locked into a triangular configuration, with the swing arm 12 bearing the soffit material 23 having achieved a generally horizontal position (as suggested in FIG. 6). The soffit material 23 is within about ½ inch from the nail rail on the framed wall of the structure. The apparatus holds the soffit 23 in a generally horizontal position while the user manipulates the soffit into final position and nails both ends in place (FIGS. 7 and 8), and then proceeds to nail the entire soffit along its length into place. The apparatus maintains position until the user moves it to initiate installation of the next segment of soffit.

Further operational detail for the embodiment utilizing the spring-biasing function of the standoff assembly is provided by making combined reference to the drawing figures. There are four basic stages in using this embodiment of the apparatus. In the first stage, the apparatus is fastened to the subfascia 21. In the second stage, the soffit 23 is placed on the swing arm 12. Thirdly, the swing arm 12 is pivoted to raise the soffit 23 into place. In the final stage, the apparatus holds the soffit 23 steadily in place until the soffit is fastened to the framing.

Reference is made to FIG. 4. The first step is to place the clamp arm 16 along the roof 25 so that the hook 60 engages the batten 27. The cam lever 36 is rotated and releases the spring 38 to apply pressure to the spring retainer 50 and in turn to the subfascia 21. The bias of the spring 38 pushes the standoff 40 away from the subfascia 21, thereby drawing the clamp arm 16 downward parallel with the roof 25 to hold the hook 60 securely against the batten 27. The apparatus thus is clamped against the subfascia 21 and the batten 27 by the spring action transmitted by the clamp arm 16, as suggested in FIG. 5. Continuing reference to FIG. 5, the soffit 23 is then placed in a reasonably balanced position upon the lower section of the swing arm 12. The soffit material 23 can balance on the swing arm 12, and be steadied by the user while the apparatus is actuated.

Figure 5:
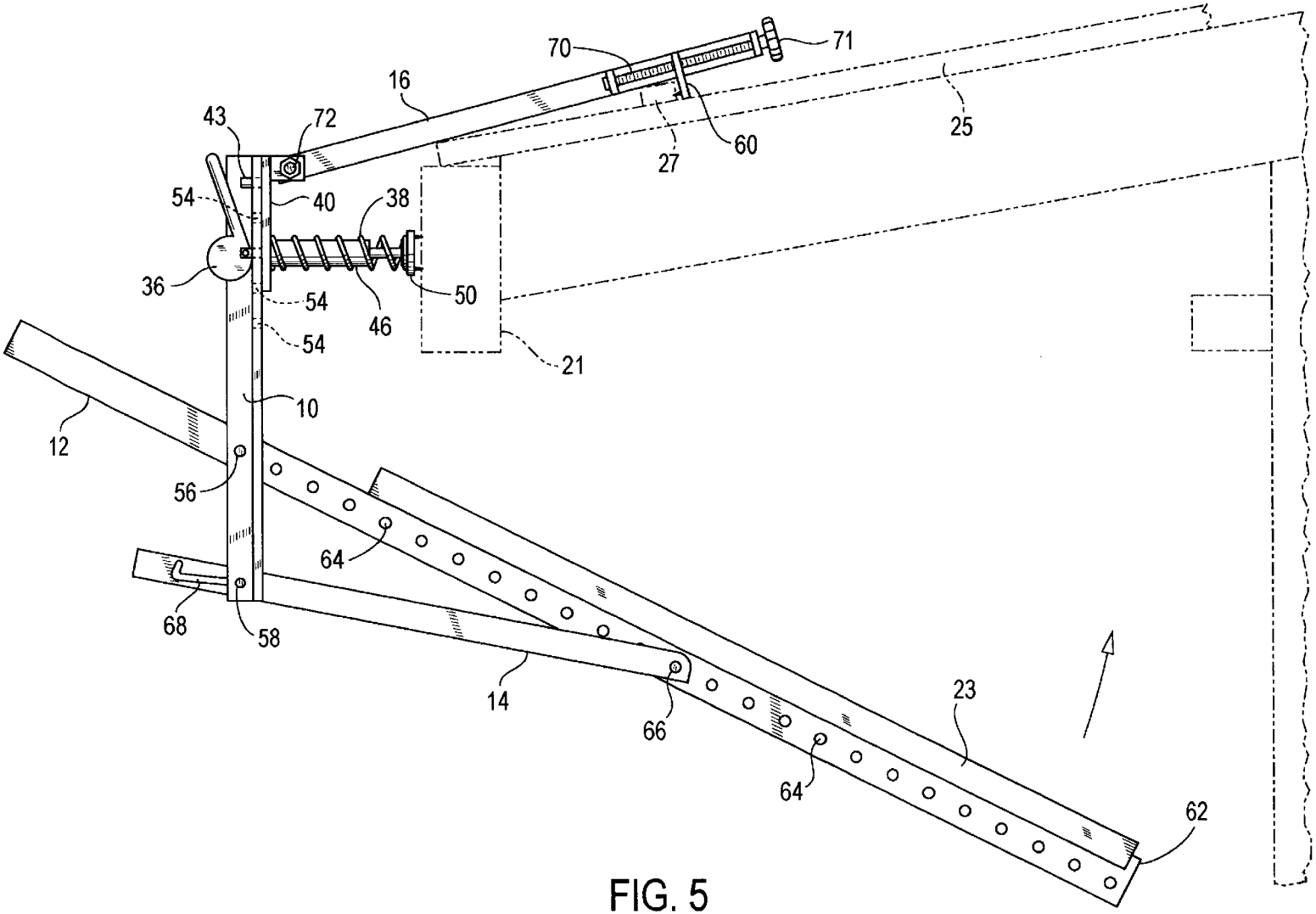
FIG. 5 is an elevation view of the embodiment seen in FIG. 4, depicting the apparatus fully attached to the building eave, and showing a portion of a soffit material in place upon the apparatus.
Figure 6:
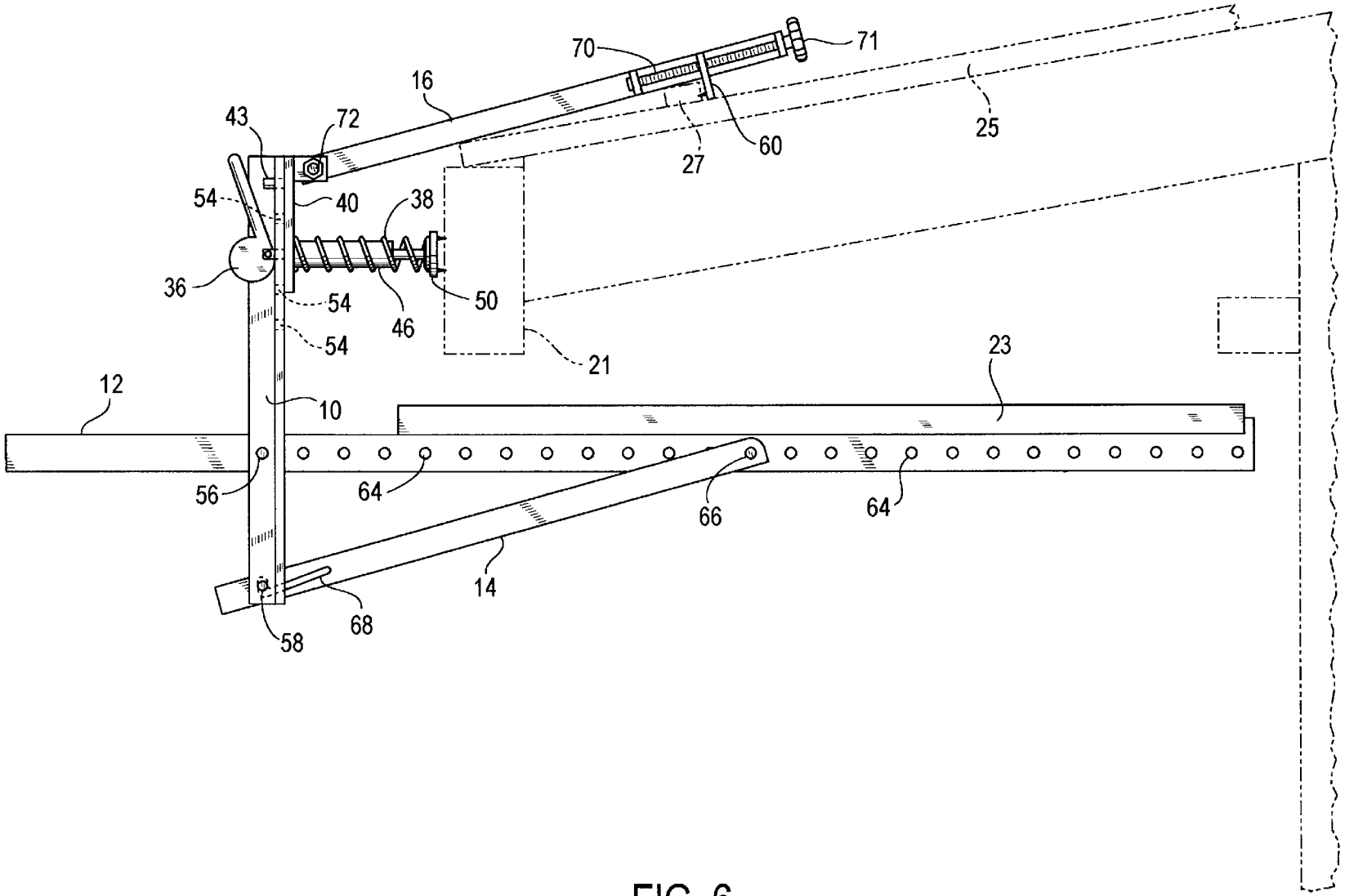
FIG. 6 is an elevation view of the apparatus seen in FIG. 5, shown later in time with the swing arm bearing the soffit material pivoted into position below the eave.
Figure 7:
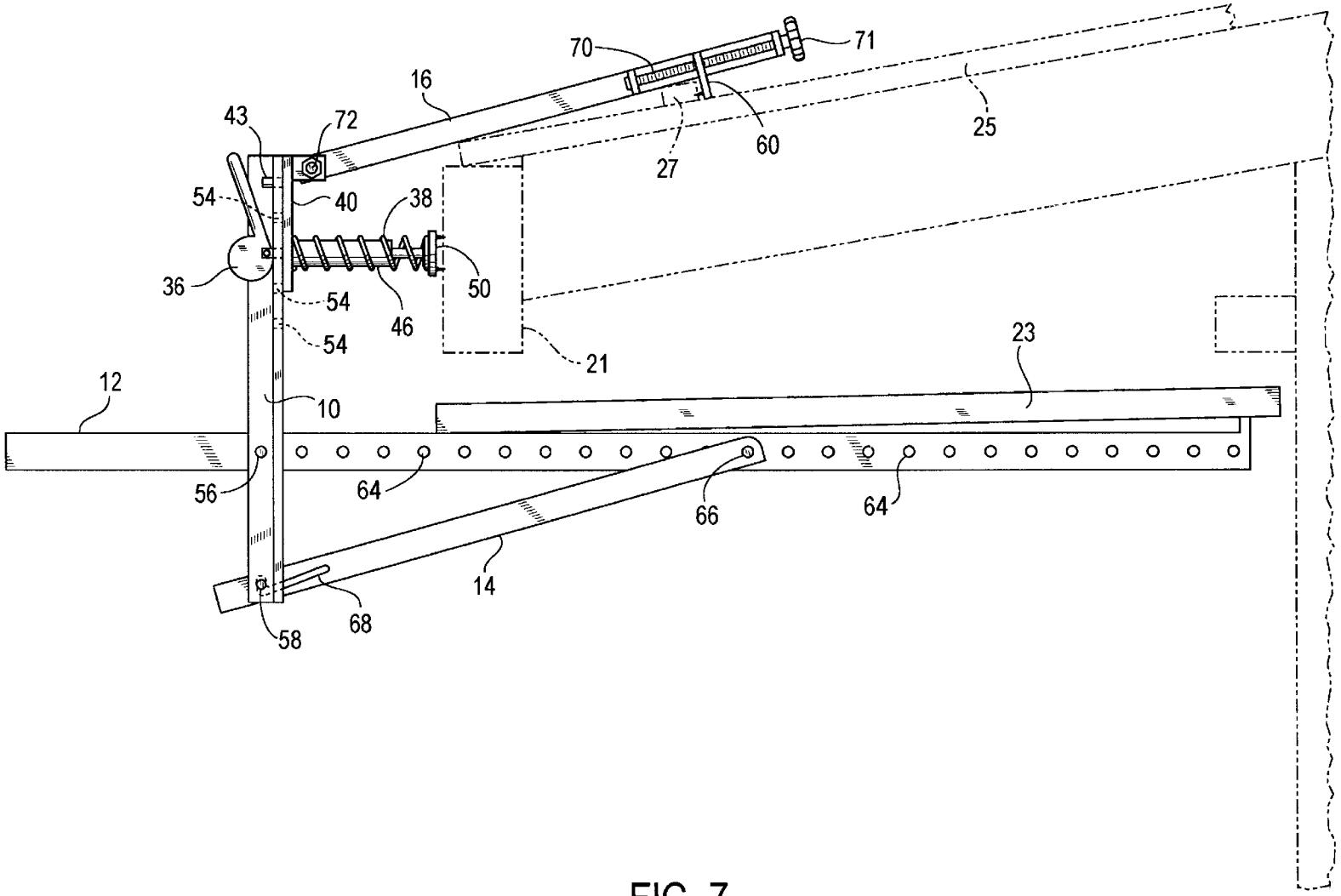
FIG. 7 is an elevation view of the apparatus seen in FIG. 6, shown later in time with the swing arm bearing the soffit material pivoted into position below the eave, and illustrating how the soffit material may be lifted off the swing arm for positioning to be attached to the eave.

The top section of the swing arm 12 is then pulled downward. This causes the swing arm 12 to pivot about its fixed pivot pinned connection with the main body 10, resulting in the raising of the lower section of the swing arm 12 which bears the soffit 23. Referring to FIGS. 5 and 6, the raising of the lower section of the swing arm 12 thus swings the soffit 23 into a generally horizontal position for installation. The J-slot 68 in the lock arm 14 slides along the pivot pin connecting the lock arm 14 to the body, allowing the lock arm to translate as well as pivot with respect to the main body 10 while the swing arm 12 is rotating. Lock arm 14 and swing arm 12 also pivot about their mutually connecting pivot pin. When the short angled leg of the J-slot 68 reaches the end of its translational movement, it drops onto the main body pin 58, which effectively locks the lock arm 14 in position with respect to the main body 10 and the swing arm 12. Thus locked in place, the stable triangular configuration of the lock arm, swing arm and main body holds the swing arm and thus the soffit material 23 in horizontal installation position as seen in FIGS. 6 and 7. The soffit 23 rests upon the swing arm 12, but may still need to be slidably positioned for nailed installation.

Figure 8:
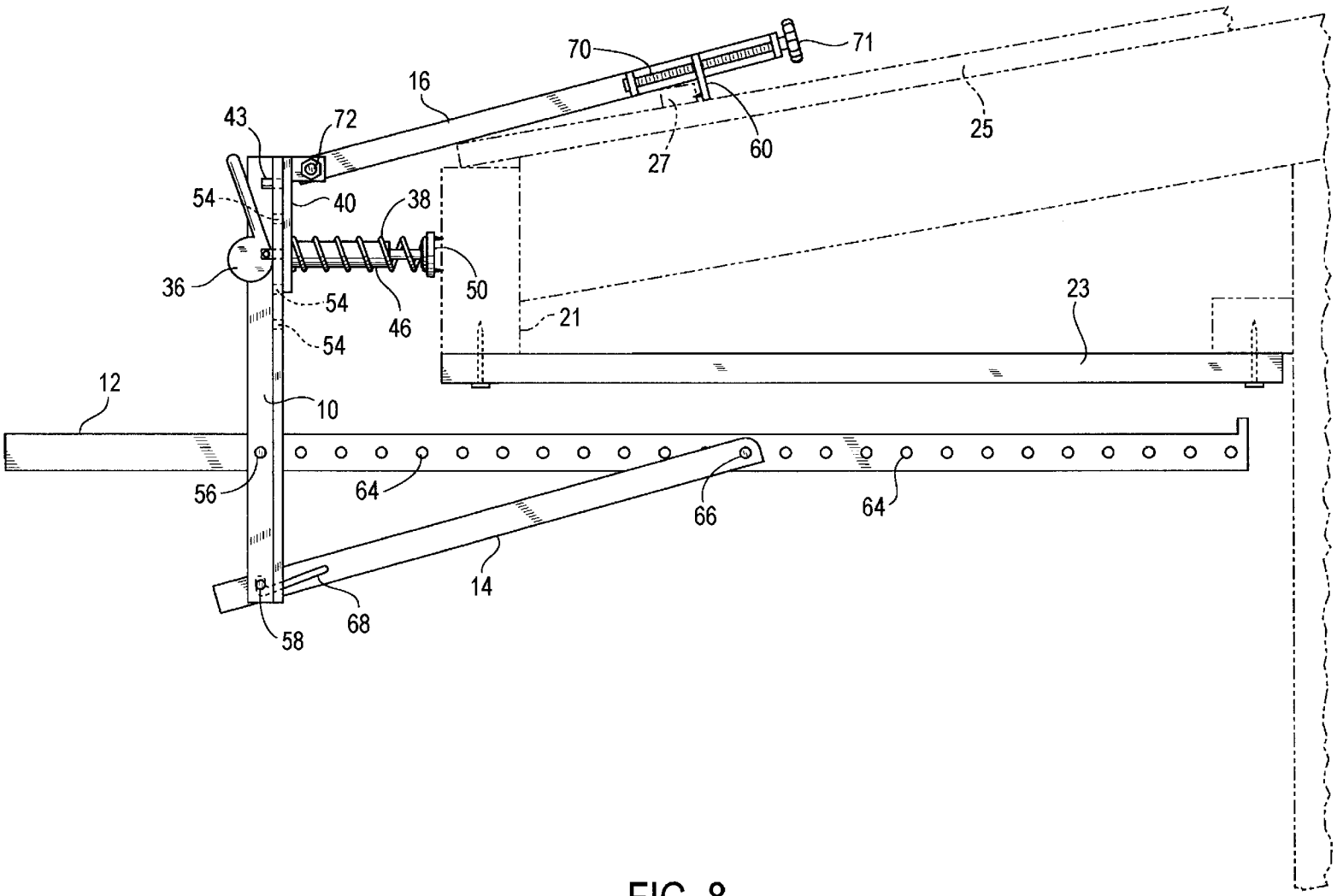
FIG. 8 is an elevation view of the apparatus seen in FIG. 7, shown later in time with the swing arm bearing the soffit material pivoted into position below the eave, and illustrating the soffit attached to the eave.

Combined reference is made to FIGS. 7 and 8. The user then lifts the soffit 23 the short distance up off the swing arm 12 and slides the soffit toward the wall. The soffit 23 can then be fastened to the nail rail and the subfascia 21 (or other framing elements) generally according to known methods. The apparatus may be removed from its temporary position upon the structure by rotating the cam lever 36, thus compressing the spring 38 and allowing the hook 60 to be lifted and disengaged from the batten 27. The apparatus may then be moved to a new location to begin a new installation cycle.

An alternative embodiment employs a standoff 40 that is temporarily screwed to the subfascia 21 to support the apparatus in place. The four basic stages of operation, as described herein above, are the same for this alternative embodiment, except that stage 1 is accomplished in a different manner to provide for more universal application. The overall general function and operation of the alternative embodiment thus is substantially similar to the previously described embodiment, and similar parts are utilized, except where hereafter noted.

Referring to FIG. 3, it is seen that in this alternative embodiment the apparatus is placed in the open position, with the lower section of the swing arm 12 hanging downward. The standoff 40 is pressed against the vertical face of the subfascia 21. A power tool is employed to drive a screw 80 into the subfascia 21, thereby temporarily securing the standoff 40 to the subfascia to maintain the apparatus in position for use. Once the soffit 23 is nailed or screwed into proper place, the swing arm 12 can be released by the user's unlocking the locking arm 14. The swing arm 12 can then be rotated to lower its distal end. The power tool is then used to back the screw out of the subfascia 21, and the apparatus is moved to a new location where the process is repeated.

A person of ordinary skill will note that by providing a series of holes 64 along a major portion of the length of the swing arm 12 and pins on locking arm 14 and main body 10, and by utilizing removable pins to connect the arms and main body together, the apparatus can be adapted to meet various size needs by planned placement of the keeper pins in appropriate holes to assemble the apparatus.

The apparatus offers a safer means for hanging soffit. The apparatus requires only one individual to operate, thus eliminating the need for two people to be on a scaffolding or ladders at the same time. One person using the apparatus can thus perform the work previously performed by two persons. Moreover, the apparatus allows the job to be performed faster, because only one person has to position himself, and because the soffit is held steadily in place until the task of nailing is finished—thus eliminating the human errors that may occur when one person holds while another person nails.

The entire disclosures of all patents, and publications cited above are hereby incorporated by reference.

What is claimed is:

1. A portable apparatus for installing a soffit material beneath a building having a roof and an eave, the eave having a subfascia, said apparatus comprising:

a main body removably attachable to the subfascia;

a swing arm pivotally connected to said body by a pivot pin and having a distal section for receiving and bearing the soffit material and a proximate section on the opposited side of said pivot pin;

a locking arm pivotally connected to said swing arm; and means for releasably locking and locking arm against movement with respect to said main body;

wherein downward force applied to said proximate section induces pivotal movement of said swing arm around said pivot pin to swing said distal portion upward to place the soffit material into position for installation under the eave.

2. An apparatus according to claim 1 further comprising means for removably attaching said main body to the subfascia.

3. An apparatus according to claim 1 wherein said means for releasably locking said locking arm against movement with respect to said main body comprises:

a J-shaped slot defined in said locking arm; and a pin affixed upon said main body and slidably engageable in said J-shaped slot;

wherein said J-shaped slot slides along said main body, allowing the locking arm to translate as well as pivot with respect to said main body while said swing arm pivots.

4. An apparatus according to claim 1 further comprising:

a plurality of holes defined in said swing arm;

a pivot pin on said locking arm;

the pivot pin on said locking arm removably insertable through any one of said holes in said swing arm thereby to establish a pivotal connection between said swing arm and said locking arm wherein the point of pivotal connection is adjustable along a substantial length of said swing arm.

5. A portable apparatus for installing a soffit material beneath a building having a roof and an eave, the eave having a subfascia, said apparatus comprising:

a main body removably attachable to the subfascia;

a swing arm for receiving and bearing the soffit material, said swing arm pivotally connected to said main body;

a locking arm pivotally connected to said swing arm; means for releasably locking said locking arm against movement with respect to said main body; and means for removably attaching said main body to the subfascia;

wherein pivotal movement of said swing arm with respect to said main body swings the soffit material into position for installation under the eave; and further wherein said main body defines a hole therein, and said means for removably attaching comprises a lag screw passable throught said hole and into the subfascia.

6. A portable apparatus for installing a soffit material beneath a building having a roof and an eave, the eave having a subfascia, said apparatus comprising:

a main body removably attachable to the subfascia;

a swing arm for receiving and bearing the soffit material, said swing arm pivotally connected to said main body;

a locking arm pivotally connected to said swing arm; means for releasably locking said locking arm against movement with respect to said main body; and means for removably attaching said main body to the subfascia, comprising;

a standoff removably connectable to said main body;

a retainer movably disposable on said standoff;

a spring for biasing said retainer away from said standoff; and a clamp arm connected to said standoff, said clamp arm having a hook engageble with the roof; and wherein pivotal movement of said swing arm with respect to said main body swings the soffit material into position for installation under the eave; and wherein when said hook is engaged with the roof, said spring biases said retainer against the subfascia thereby clamping the apparatus in position for use.

7. An apparatus according to claim 6 further comprising:

a plurality of adjusting holes defined in said main body; and a pin extending from said standoff, said pin removably insertable into any selected one of said adjusting holes in said main body;

wherein when said pin is removably inserted into a selected one of said adjusting holes, said retainer is insertable into another selected one of said adjusting holes, whereby the removable connection of said standoff to said main body is adjustable to accommodate sub-fascia of varying depths.

8. An apparatus according to claim 6 further comprising:

a screw upon said clamp arm and engaged with said hook; and a knob on said screw whereby said screw may be rotated to adjust the position of said hook along the length of said clamp arm.

9. A portable apparatus for installing a soffit material beneath a building having a roof and an eave, the eave having a sub-fascia, said apparatus comprising:

a main body removably attachable to the sub-fascia;

a swing arm for receiving and bearing the soffit material, said swing arm pivotally connected to said main body;

a locking arm pivotally connected to said swing arm;

a J-shaped slot defined in said locking arm; and a pin affixed upon said main body and slidably engageable in said J-shaped slot;

whereon said J-shaped slot slides along said main body on said pin, allowing the locking arm to translate as well as pivot with respect to said main body while said swing arm pivots, and said pin is engageable in said slot to lock said locking arm against movement with respect to said main body, and wherein pivotal movement of said swing arm with respect to said main body swings the soffit material into a generally horizontal position for installation.

10. An apparatus according to claim 9 further comprising:

a standoff removably connectable to said main body;

a retainer movably disposable on said standoff;

a spring for biasing said retainer away from said standoff; and a clamp arm connected to said standoff, said clamp arm having a hook engageable with the roof;

wherein when said hook is engaged with the roof, said spring biases said retainer against the sub-fascia thereby clamping the apparatus in position for use.

11. An apparatus according to claim 10 further comprising:

a plurality of holes defined in said swing arm;

a pivot pin on said locking arm;

the pivot pin on said locking arm removably insertable through any one of said holes in said swing arm thereby to establish a pivotal connection between said swing arm and said locking arm wherein the point of pivotal connection is adjustable along a substantial length of said swing arm.

12. An apparatus according to claim 11 further comprising:

a plurality of adjusting holes defined in said main body; and a pin extending from said standoff, said pin removably insertable into any selected one of said adjusting holes in said main body;

wherein when said pin is removably inserted into a selected one of said adjusting holes, said retainer is insertable into another selected one of said adjusting holes, whereby the removable connection of said standoff to said main body is adjustable to accommodate sub-fascia of varying depths.

13. An apparatus according to claim 12 further comprising:

a screw upon said clamp arm and engaged with said hook; and a knob on said screw whereby said screw may be rotated to adjust the position of said hook along the length of said clamp arm.

* * * * *